US005813643A

United States Patent [19]

Zybert

[11] Patent Number: 5,813,643

[45] Date of Patent: Sep. 29, 1998

[54] CYLINDER HOLDER FOR CYLINDRICAL TANK

[76] Inventor: Mark Zybert, 13080 Mortons Corners Rd., Springville, N.Y. 14141

[21] Appl. No.: 927,875

[22] Filed: Sep. 11, 1997

[51] Int. Cl.[6] ..... A47F 5/00

[52] U.S. Cl. ..... 248/310; 248/154

[58] Field of Search ..... 248/310, 314, 248/315, 309.1, 154, 311.2, 346.01, 346.03, 519

[56] References Cited

U.S. PATENT DOCUMENTS

| | | | |
|---|---|---|---|
| 1,622,587 | 3/1927 | Housel | 248/154 X |
| 4,971,276 | 11/1990 | Tannenbaum | 248/310 X |
| 5,292,140 | 3/1994 | Laing | 248/311.2 X |
| 5,676,340 | 10/1997 | Ruhnau | 248/310 X |

FOREIGN PATENT DOCUMENTS

| | | | |
|---|---|---|---|
| 2451732 | 11/1980 | France | 248/154 |

*Primary Examiner*—Ramon O. Ramirez

[57] ABSTRACT

A cylinder holder is provided for supporting a cylinder while the assembly rests on a generally horizontally oriented work surface. A radially disposed support surface provides for contact with the work surface. A tank contacting chamber is provided which has a tank contacting surface radially disposed therein which contacts a lower tank outer surface of the cylindrical tank in close proximity to a sealed end. The tank contacting chamber also has a plurality of extensions radially disposed therein to extend inward from a lower extent of the tank contacting surface. These extensions contact the sealed end of the cylindrical tank while the cylindrical tank is positioned within the tank contacting chamber. Connection means are provided to position the support surface relative to the tank contacting chamber. Binding means are provided to produce a compression contact between at least a portion of the tank contacting surface of the tank contacting chamber and the lower tank outer surface of the cylindrical tank while the cylindrical tank is positioned within the tank contacting chamber. This combination provides for the cylinder holder to be retained on the cylindrical tank during usage of the cylindrical tank while allowing for the cylindrical tank to be unattendedly positioned in a vertically oriented position on the work surface.

20 Claims, 4 Drawing Sheets

CYLINDER HOLDER FOR CYLINDRICAL TANK

BACKGROUND

1. Field of the Invention

Generally the invention relates to a holder for cylinders. More specifically the invention relates to such a holder for a propane torch having a cylindrical tank where the cylindrical tank is to be unattendedly held in a vertically oriented position on a horizontally oriented work surface.

2. Description of the Prior Art

Various attempts have been made to provide a holder for cylinders. These attempts have been less efficient than desired. As such, it may be appreciated that there continues to be a need for a holder which may be easily manufactured and which increases the supporting surface area to stabilize the cylinder while the cylinder rests upright in a generally vertically orientated position. The present invention substantially fulfills these needs.

SUMMARY

In view of the foregoing disadvantages inherent in the known types of holders for cylinders, your applicant has devised a cylinder holder which significantly increases a supporting surface area compared to the supporting surface area of the base of the cylinder while providing for a secure compression attachment of the holder to the cylinder while enabling the holder to be economically formed by a molding process. The cylinder holder comprises a unique combination of the following features. A support surface is provided for supporting the cylinder holder on a generally horizontally oriented work surface. A tank contacting chamber is provided which has a tank contacting surface radially disposed therein which contacts a lower tank outer surface of the cylindrical tank in close proximity to a sealed end. The tank contacting chamber also has a plurality of extensions radially disposed to extend inward from a lower extent of the tank contacting surface which contact the sealed end of the cylindrical tank while the cylindrical tank is positioned within the tank contacting chamber. Connection means are provided to position the support surface relative to the tank contacting chamber. Binding means are provided to produce a compression contact between at least a portion of the tank contacting surface of the tank contacting chamber and the lower tank outer surface of the cylindrical tank while the cylindrical tank is positioned within the tank contacting chamber. This combination provides for the cylinder holder to be retained on the cylindrical tank during usage of the cylindrical tank while allowing for the cylindrical tank to be positioned in a vertically oriented position on the work surface.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The primary object of the present invention is to provide for a device to hold a cylinder in an upright position on a work surface.

Other objects include;

a) to provide for a cylinder holder which may be easily and safely attached to a sealed end of the cylinder.

b) to provide for a cylinder holder which has a support surface thereon which distributes the weight of the cylinder over a significantly greater area of the work surface than that area of the work surface utilized by the base of the cylinder in the absence of a holder device.

c) to provide for a cylinder holder having radially disposed extensions to contact the base of the cylinder.

d) to provide for the extensions to have an elevational height above an elevational height of the support surface of the cylinder holder to ensure that only the support surface contacts the work surface thereby ensuring stability of the assembly.

e) to provide for a uniform tapering of at least a portion of a tank contacting surface of the cylinder holder to provide for a compression contact with the cylinder.

f) to provide for a separation void within the radially disposed tank contacting surface between each adjacent pair of extensions wherein the extensions extend from the tank contacting surface to allow for an outward compression deforming of the tank contacting surface adjacent each extension during insertion of the cylinder.

g) to provide for a connection member between the support surface and the tank contacting chamber to have a uniformly dimensioned, upwardly disposed, arc to enhance the structural integrity of the cylinder holder to prevent deformation when the cylinder is full.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
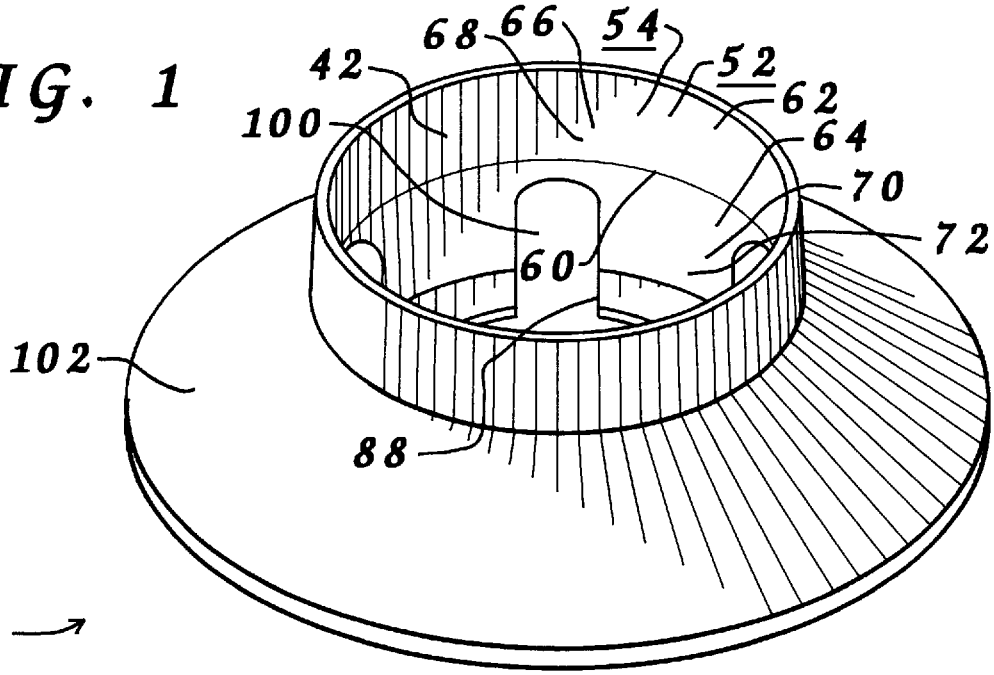
FIG. 1 is a perspective view of a cylinder holder.
Figure 2:
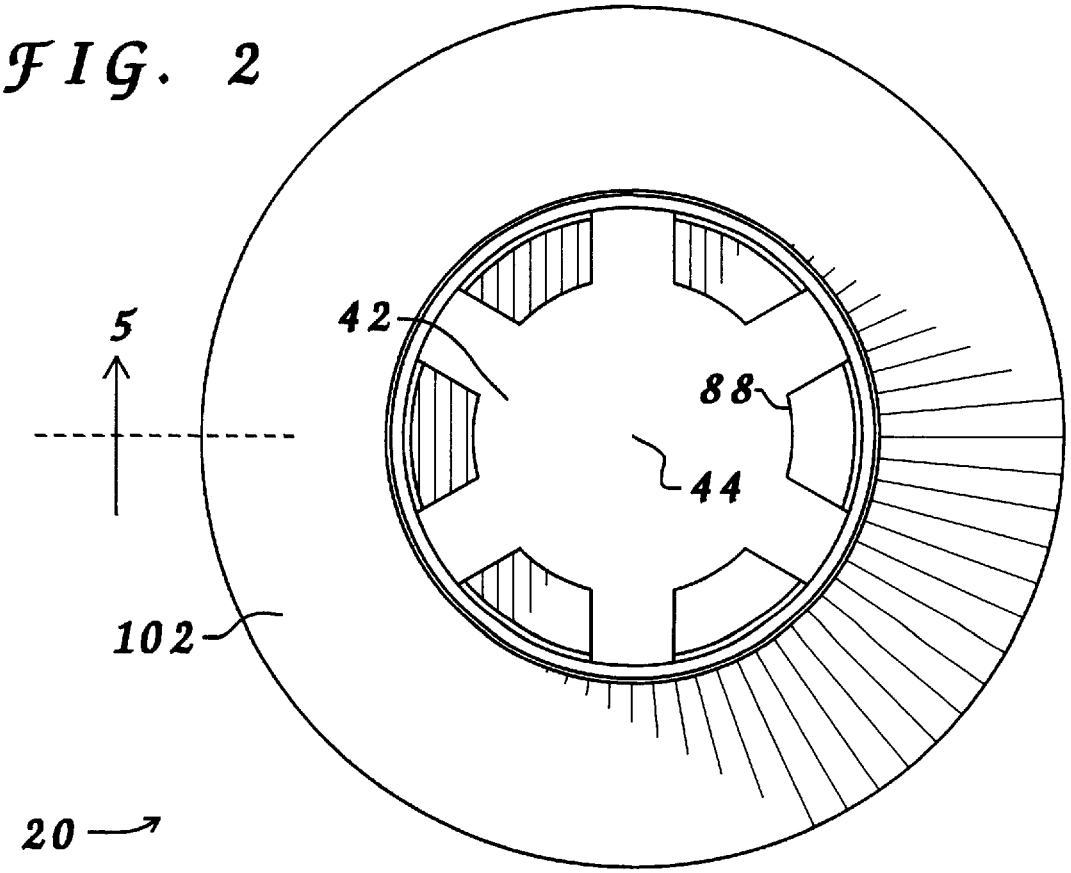
FIG. 2 is a top plan view of the cylinder holder.
Figure 3:
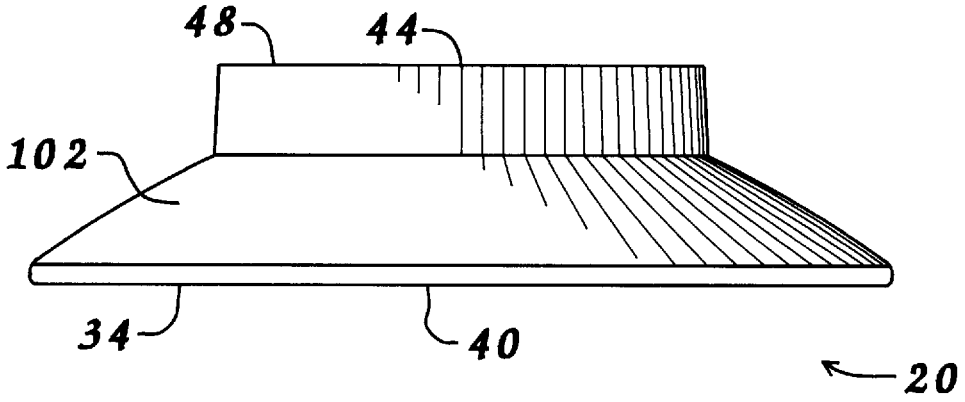
FIG. 3 is an elevational view of the cylinder holder.
Figure 4:
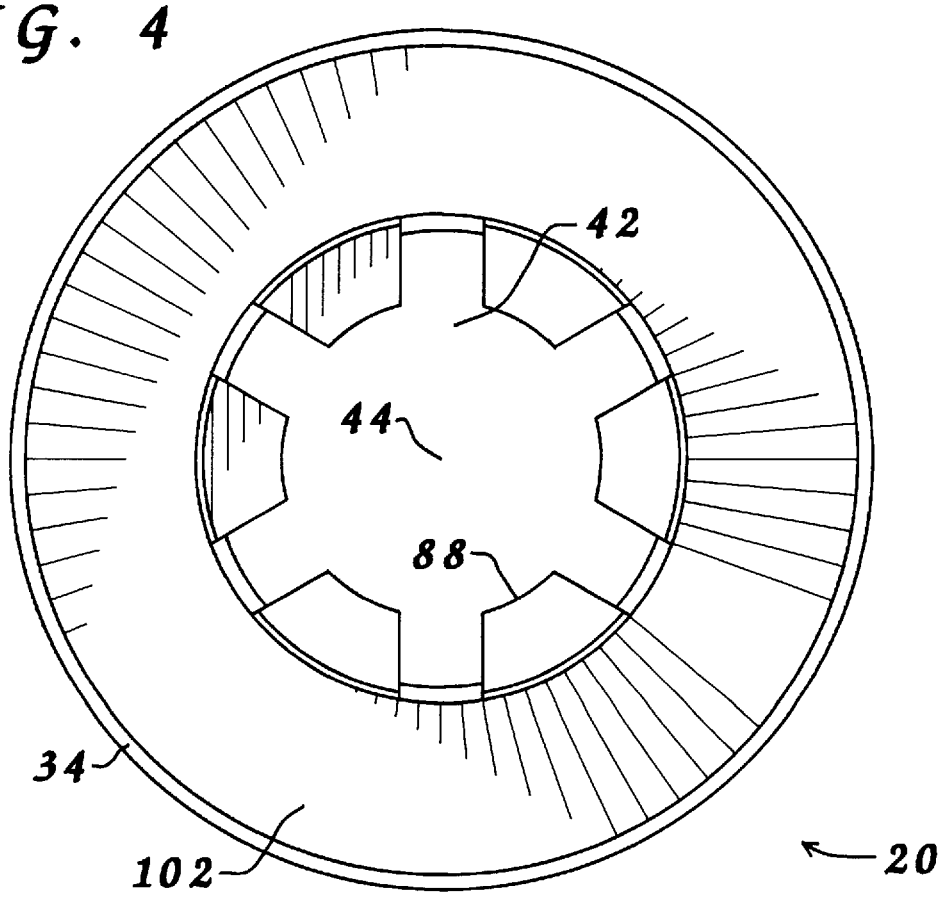
FIG. 4 is a bottom plan view of the cylinder holder.
Figure 5:
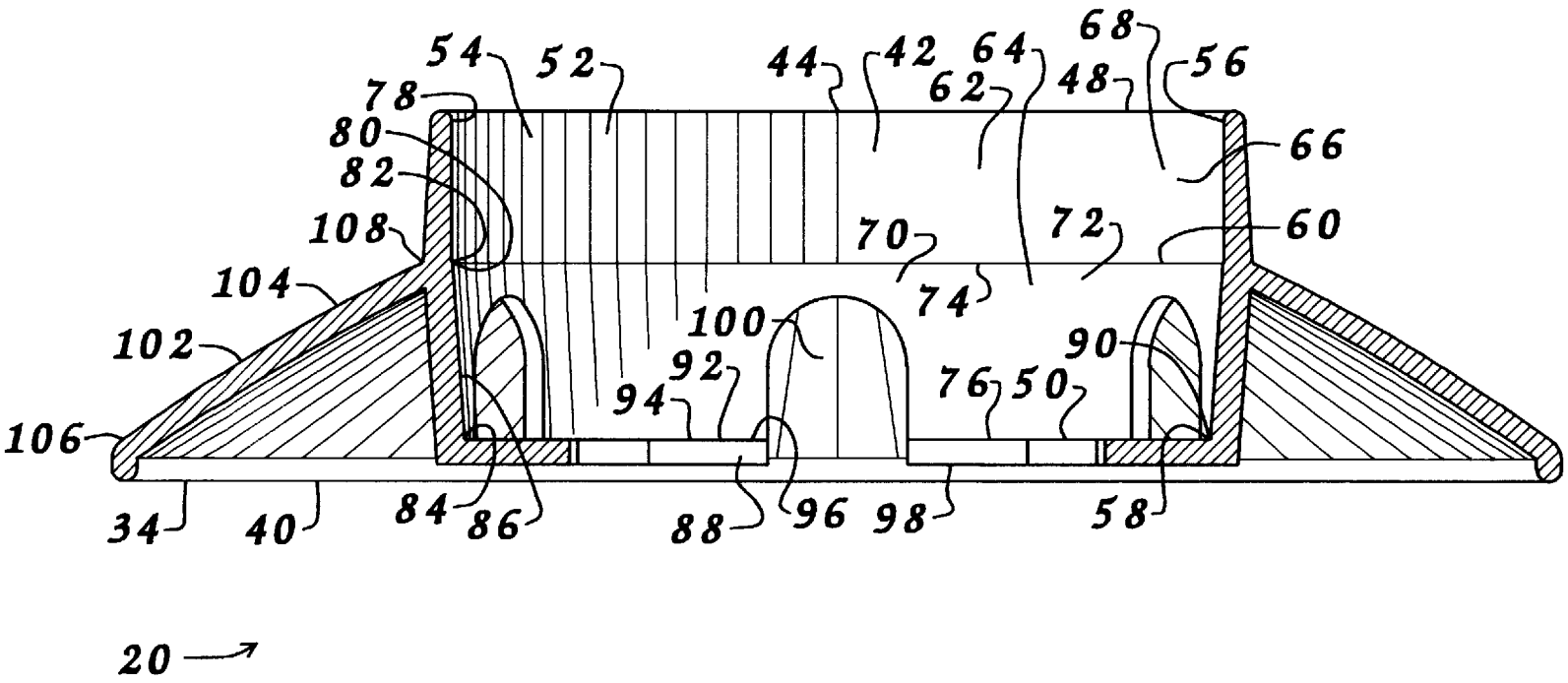
FIG. 5 is a sectional view as taken from the section line '5' shown in FIG. 2.

It is a desire to retain a cylinder for unattended vertical positioning on a generally horizontal work surface wherein adequate support exist to reduce any tendency of the cylinder to move from that vertical position, as exampled by tipping or falling over. To that end it is a requirement to provide a device which may be attached to a sealed end of the cylinder wherein such attachment relies solely upon pressure gripping of the cylinder. Additionally, it is a requirement that the area over which the support is distributed be expanded beyond the perimeter of the walls of the cylinder. One example of such a device, and the assembly of the device and a cylindrical tank, are depicted for illustrative purposes herein.

Referring now to the drawings where like reference numerals refer to like parts throughout the various views. A cylinder holder 20 is depicted in FIG. 1 through FIG. 7. Cylinder holder 20 is preferably so shaped and dimensioned as to permit construction thereof by injection molding. Such a construction allows for a one piece unit which has a desired degree of flexibility while remaining resilient to afford a long service life during repeated uses, including being repeatedly installed on and removed from cylinders.

Figure 6:
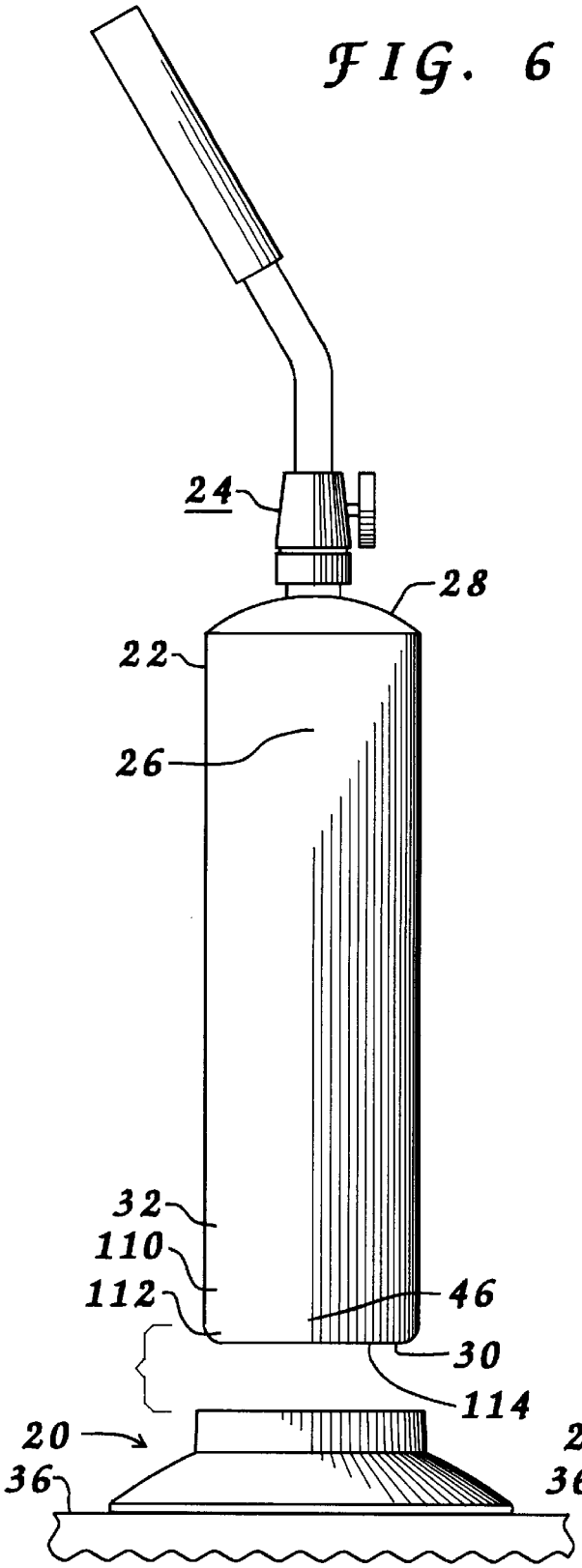
FIG. 6 is an elevational view of the cylinder holder and a propane cylinder.
Figure 7:
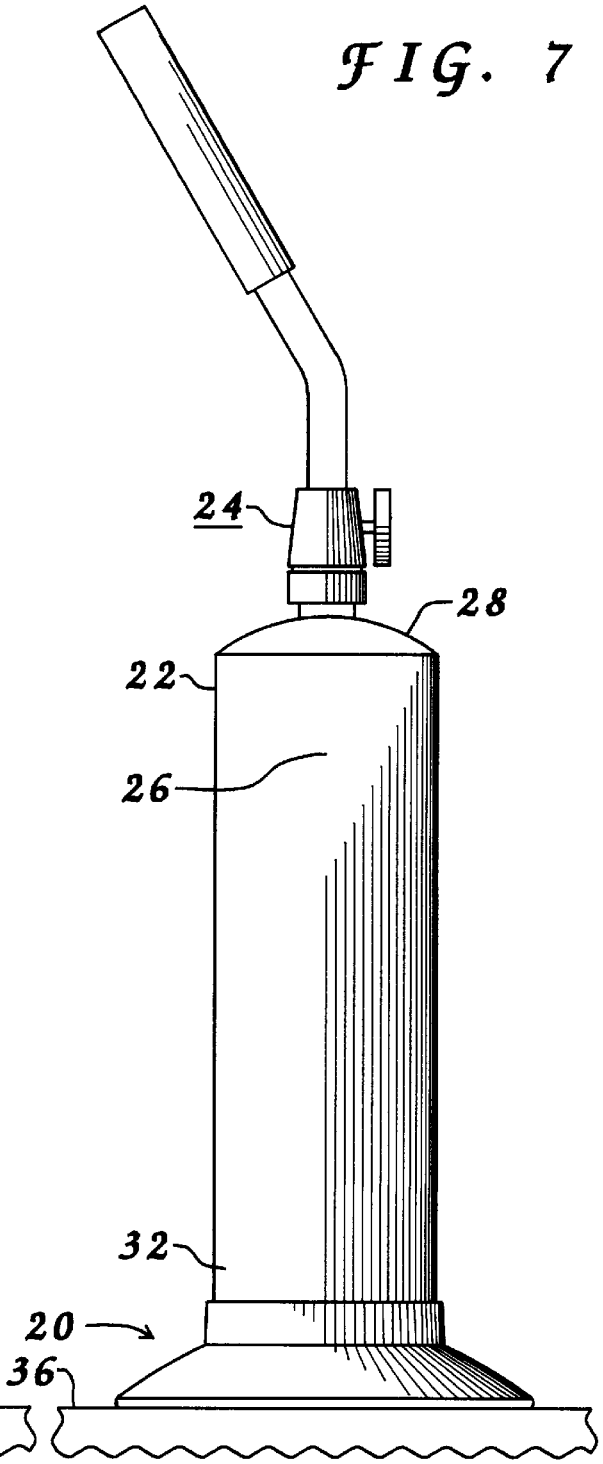
FIG. 7 is an elevational view of the propane cylinder installed within the cylinder holder.

A cylindrical tank 22 is depicted in FIG. 6 and FIG. 7. While cylinder holder 20 may be used with several types of cylinders, a common type of cylinder to be utilized is a propane torch 24. Propane torch 24 may be used by plumbers and other persons who must alternate between manual manipulation of propane torch 24 and manual manipulation of other components, as exampled by plumbing components. Typically, such persons must extinguish the flame of propane torch 24 follow manipulation thereof and then reignite the flame when manipulation resumes due to the unstable nature of propane torch 24. Cylindrical tank 22 has a central axis 26 along the longitudinal length with a valve end 28 and a sealed end 30 distributed at opposing end thereon. Cylindrical tank 22 has a lower tank outer surface 32 which is uniformly dimensioned as it extends from sealed end 30 along the longitudinal length at least a portion of the way to valve end 28.

It is a desire to distribute the weight of the assembly over the work surface to increase support of the assembly. Numerous shapes may be employed to facilitate such weight distribution. Cylinder holder 20 has a support surface 34 which is depicted as having the preferred circular configuration. Support surface 34 will rest upon a work surface 36, see FIG. 6 and FIG. 7, while providing ample support to cylindrical tank 22 installed within cylinder holder 20. Support surface 34 has an elevational height 40, see FIG. 5, relative to other structures of cylinder holder 20, more fully described below. It is a strong desire that only support surface 34 contact work surface 36 during usage.

It is a requirement to provide for attachment of the device to the cylinder. A radial pressure bearing contact is the preferred method of attachment. Cylinder holder 20 has a tank contacting chamber 42, depicted as having a circular shape, which has a central axis 44. Tank contacting chamber 42 accepts a portion 46 of cylindrical tank 22 installed therein. Tank contacting chamber 42 has an upper extent 48 and a lower extent 50. A tank contacting surface 52 defines a vertically oriented perimeter 54, or side perimeter, of tank contacting chamber 42. Tank contacting surface 52 is positioned radially about central axis 44. Tank contacting chamber 42 has an upper diametric measurement 56 and a lower diametric measurement 58. It is preferred that lower diametric measurement 58 be smaller than upper diametric measurement 56 to provide for a compression contact between tank contacting surface 52 and cylindrical tank 22, more fully described below.

Vertically oriented perimeter 54 preferably is divided by a transition line 60 to define an upper portion 62 and a lower portion 64. Upper portion 62 has an upper contacting surface 66 defining an upper side perimeter 68. Lower portion 64 has a lower contacting surface 70 defining a lower side perimeter 72 residing between an upper extent 74 and a lower extent 76. Upper portion 62 has an upper diametric measurement 78 and a lower diametric measurement 80. Lower portion 64 similarly has an upper diametric measurement 82 and a lower diametric measurement 84. Lower diametric measurement 80 of upper portion 62 is, of course, of equal measurement to upper diametric measurement 82 of lower portion 64. It is preferred that lower portion 64 have a uniform taper 86 between upper extent 74 and lower extent 76. It is also preferred that upper diametric measurement 78 of upper portion 62 and lower diametric measurement 80 of upper portion 62 be equal, or nearly equal.

It is a desire to provide for the seating of cylindrical tank 22 within cylinder holder 20. Preferable, sealed end 30 of cylindrical tank 22 makes contact with structural elements of cylinder holder 20. A particularly expedient method of accomplishing this end is to provide for a plurality of extensions 88 radially disposed about central axis 44 within tank contacting chamber 42. Each extension 88 extends from a lower extent 90 of tank contacting surface 52. In this embodiment extensions 88 form a lower perimeter 92 of tank contacting chamber 42 and provide for contact with sealed end 30 of cylindrical tank 22. Extensions 88 are depicted as planar and have a generally common plane 94 and therefore, a common elevational height 96 at a lowest extent 98 relative to cylinder holder 20. Extensions 88 provide for a seating contact of cylindrical tank 22 within tank contacting chamber 42.

It is a desire that an outward compression deforming occur to each extension 88 and a portion of tank contacting surface 52 adjacent the respective extension 88 during an insertion of cylindrical tank 22 into tank contacting chamber 42. This is easily accomplished by a cooperation between the previously disclosed uniform taper 86 of lower portion 64 and a separation void 100 which separates each adjacent pair of extensions 88. Each separation void 100 penetrates tank contacting surface 52 beginning at lower extent 90 of tank contacting surface 52 and extends part of the way to upper extent 48 of tank contacting chamber 42. Preferably each separation void 100 extents to a point in close proximity to transition line 60. While numerous configurations are possible for extensions 88 and separation voids 100, preferably there will be at least two (2) of each and more preferably a greater number. Experimentation has indicated that the most preferred number of each is six (6).

It is a requirement that support surface 34 be fixedly positioned relative to tank contacting chamber 42. While numerous configurations may be employed to facilitate such connection means, a particularly expedient method is to provide a connection member 102 to radially surround, and contact, the outer structure of tank contacting chamber 42. While numerous positions exist on the outer structure of tank contacting chamber 42 to make such contact, a particularly expedient positioning is to make the contact approximately midpoint. This placement affords easy access to upper extent 48 of tank contacting chamber 42 while allowing for an elevated placement of lowest extent 98 of tank contacting chamber 42 relative to support surface 34. In order to increase the weight bearing properties of connection member 102 it is preferred that connection member 102 have a uniformly dimensioned upwardly disposed arc 104 between any select point 106 adjacent support surface 34 and a respective nearest intersection point 108 adjacent tank contacting chamber 42.

During usage, cylinder holder 20 is installed on cylindrical tank 22 by insertion of sealed end 30 into tank contacting chamber 42. In the embodiment depicted, a first portion 110 of cylindrical tank 22 in close proximity to sealed end 30 contacts upper contacting surface 66. A second portion 112 of cylindrical tank 22, in even closer proximity to sealed end 30, contacts lower contacting surface 70 and deforms certain portions thereof outwardly to produce a compression contact therebetween. A third portion 114 of cylindrical tank 22, comprising portions of sealed end 30, contact extensions 88 to produce a seating contact.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling with the scope of the invention.

I claim;:

1. A cylinder holder to provide for an unattended holding of a cylindrical tank in a vertically oriented position on a work surface, the cylindrical tank having a valve end located at one end of the cylindrical tank, a sealed end located at the opposing end of the cylindrical tank and a lower tank outer surface uniformly dimensioned and radially disposed to extend from the sealed end along the cylindrical tank at least a portion of the way to the valve end, the cylinder holder comprising:

a) a support surface to provide for a contact with the work surface wherein the work surface is generally horizontally oriented;

b) a tank contacting chamber to provide for receiving a portion of the cylindrical tank, the portion of the cylindrical tank in close proximity to the sealed end, the tank contacting chamber comprising:

1) a tank contacting surface radially disposed about the tank contacting chamber, the tank contacting surface defining a vertically oriented perimeter of the tank contacting chamber and having a lower extent, the tank contacting surface to provide for a contact with the lower tank outer surface in close proximity to the sealed end of the cylindrical tank;

2) a plurality of extensions, each extension radially disposed about the tank contacting chamber and extending inward from the lower extent of the tank contacting surface, the plurality of extensions defining a lower perimeter of the tank contacting chamber, the extensions to provide for a contact with the sealed end of the cylindrical tank;

c) connection means to provide for positioning the support surface relative to the tank contacting chamber;

d) binding means to provide for a compression contact between at least a portion of the tank contacting surface of the tank contacting chamber and the lower tank outer surface of the cylindrical tank while the cylindrical tank is positioned within the tank contacting chamber to provide for retaining the cylinder holder on the cylindrical tank;

whereby the cylinder holder is retained on the cylindrical tank by the compression contact of the tank contacting surface with the lower tank outer surface of the cylindrical tank.

2. The cylinder holder defined in claim 1 wherein the tank contacting surface further comprises an upper diametric measurement and a lower diametric measurement and wherein the lower diametric measurement is smaller than the upper diametric measurement.

3. The cylinder holder defined in claim 1 wherein each of the extensions is planar and each reside on a common plane.

4. The cylinder holder defined in claim 1 wherein the cylinder holder is of a one piece construction.

5. The cylinder holder defined in claim 1 wherein the connection means further comprises a connection member to provide for the positioning of the support surface relative to the tank contacting chamber, the connection member radially disposed about the tank contacting chamber and intersecting the tank contacting chamber between an upper extent of the tank contacting chamber and a lower extent of the tank contacting chamber.

6. The cylinder holder defined in claim 1 wherein the support surface further comprises an elevational height and each extension has a lowest extent with the lowest extents of the extensions each have a common elevational height and the common elevational height of the extensions is higher than the elevational height of the support surface.

7. The cylinder holder defined in claim 1 wherein the plurality of extensions number six.

8. A cylinder holder to provide for an unattended holding of a propane torch in a vertically oriented position on a work surface, the propane torch having a cylindrical tank, the cylindrical tank having a longitudinal length, a central axis aligned along the longitudinal length, a valve end located at one end of the cylindrical tank along the longitudinal length, a sealed end located at the opposing end of the cylindrical tank and a lower tank outer surface uniformly dimensioned and radially disposed extending from the sealed end along the longitudinal length at least a portion of the way to the valve end, the cylinder holder comprising:

a) a support surface to provide for a contact with the work surface wherein the work surface is generally horizontally oriented;

b) a tank contacting chamber having a central axis which generally aligns with the central axis of the cylindrical tank while the cylindrical tank is positioned within the tank contacting chamber, the tank contacting chamber comprising:

1) a tank contacting surface radially disposed about the central axis of the tank contacting chamber, the tank contacting surface defining a side perimeter of the tank contacting chamber and having a lower extent, the tank contacting surface to provide for a contact with the lower tank outer surface in close proximity to the sealed end of the cylindrical tank;

2) a plurality of separation voids, each separation void extending upperward within the tank contacting surface from the lower extent of the tank contacting surface;

3) a plurality of extensions, each extension radially disposed about the central axis of the tank contacting chamber and extending inward from the lower extent of the tank contacting surface toward the central axis of the tank contacting chamber, the plurality of extensions defining a lower perimeter of the tank contacting chamber, the extensions to provide for a contact with the sealed end of the cylindrical tank while the cylindrical tank is positioned within the tank contacting chamber;

c) connection means to provide for positioning the support surface relative to the tank contacting chamber;

d) binding means to provide for a compression contact between the tank contacting surface of the tank contacting chamber and the lower tank outer surface of the cylindrical tank while the cylindrical tank is positioned within the tank contacting chamber to provide for retaining the cylinder holder on the cylindrical tank;

whereby the cylinder holder is retained on the cylindrical tank by the compression contact between the tank contacting surface and the lower tank outer surface.

9. The cylinder holder defined in claim 8 wherein the tank contacting surface further comprises an upper portion and a lower portion and wherein the lower portion has an upper diametric measurement and a lower diametric measurement and the lower diametric measurement of the lower portion is smaller than the upper diametric measurement of the lower portion.

10. The cylinder holder defined in claim 9 wherein the tank contacting surface of the lower portion further comprises a uniform taper from the upper diametric measurement to the lower diametric measurement.

11. The cylinder holder defined in claim 8 wherein the tank contacting surface further comprises an upper diametric measurement and a lower diametric measurement and wherein the lower diametric measurement is smaller than the upper diametric measurement.

12. The cylinder holder defined in claim 8 wherein the cylinder holder is of a one piece construction.

13. The cylinder holder defined in claim 8 wherein the connection means further comprises a connection member to provide for the positioning of the support surface relative to the tank contacting chamber and wherein the connection member is radially disposed about the tank contacting chamber and the connection member has a uniformly dimensioned upwardly disposed arc from any select point adjacent the support surface to a nearest intersection point between the connection member and the tank contacting chamber.

14. The cylinder holder defined in claim 8 wherein the support surface further comprises an elevational height and each extension further has a lowest extent with the lowest extents of each of the extensions having a common elevational height and wherein the common elevational height of the extensions is higher than the elevational height of the support surface.

15. A cylinder holder to provide for an unattended holding of a propane torch in a vertically oriented position on a work surface, the propane torch having a cylindrical tank, the cylindrical tank having a longitudinal length, a central axis aligned along the longitudinal length, a valve end located at one end of the cylindrical tank along the longitudinal length, a sealed end located at the opposing end of the cylindrical tank and a lower tank outer surface uniformly dimensioned and radially disposed extending from the sealed end along the longitudinal length at least a portion of the way to the valve end, the cylinder holder comprising:

a) a support surface to provide for a contact with the work surface wherein the work surface is generally horizontally oriented;

b) a tank contacting chamber having a central axis which generally aligns with the central axis of the cylindrical tank while the cylindrical tank is positioned within the tank contacting chamber, the tank contacting chamber comprising:

1) an upper contacting surface radially disposed about the central axis of the tank contacting chamber, the upper contacting surface defining an upper side perimeter of the tank contacting chamber, the upper contacting surface to provide for a contact with a first portion of the cylindrical tank, the first portion comprising a section of the lower tank outer surface in close proximity to the sealed end of the cylindrical tank;

2) a lower contacting surface radially disposed about the central axis of the tank contacting chamber below the upper contacting surface, the lower contacting surface having an upper extent having a diametric measurement and a lower extent having a diametric measurement, the diametric measurement of the lower extent being lesser than the diametric measurement of the upper extent, the lower contacting surface defining a lower side perimeter of the tank contacting chamber, the lower contacting surface to provide for a contact with a second portion of the cylindrical tank, the second portion comprising a section of the lower tank outer surface in close proximity to the sealed end of the cylindrical tank;

3) a plurality of separation voids, the separation voids radially disposed about the lower contacting surface;

4) a plurality of extensions, each extension radially disposed about the central axis of the tank contacting chamber and extending inward from the lower extent of the lower contacting surface toward the central axis of the tank contacting chamber, the plurality of extensions defining a lowest extent of the tank contacting chamber, the extensions to provide for a seating contact with a third portion of the cylindrical tank, the third portion comprising at least a portion of the sealed end of the cylindrical tank;

c) a connection member radially disposed about the tank contacting chamber to provide for positioning the support surface relative to the tank contacting chamber;

d) binding means to provide for an outward compression deforming of the lower contacting surface during an insertion of the cylindrical tank within the tank contacting chamber;

whereby the cylinder holder is retained on the cylindrical tank of the propane torch by the outward compression deforming of the lower contacting surface of the tank contacting chamber.

16. The cylinder holder defined in claim 15 wherein the tank contacting surface of the lower portion further comprises a uniform taper from the upper diametric measurement to the lower diametric measurement.

17. The cylinder holder defined in claim 15 wherein the cylinder holder is of a one piece construction.

18. The cylinder holder defined in claim 15 wherein the connection member further comprises a uniformly dimensioned upwardly disposed arc taken from any select point adjacent the support surface to a nearest intersection point between the connection member and the tank contacting chamber.

19. The cylinder holder defined in claim 15 wherein the connection member further provides for positioning a lowest extent of the extensions elevationally above an elevational height of the support surface.

20. The cylinder holder defined in claim 15 wherein the plurality of extensions number six and the plurality of voids number six.

* * * * *